US010891902B2

(12) United States Patent
Xue

(10) Patent No.: US 10,891,902 B2
(45) Date of Patent: Jan. 12, 2021

(54) DRIVING CIRCUIT OF DISPLAY DEVICE

(71) Applicant: Shenzhen China Star Optoelectronics Semiconductor Display Technology Co., Ltd, Shenzhen (CN)

(72) Inventor: Yan Xue, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/603,286

(22) PCT Filed: Aug. 8, 2019

(86) PCT No.: PCT/CN2019/099700
§ 371 (c)(1),
(2) Date: Oct. 7, 2019

(87) PCT Pub. No.: WO2020/224077
PCT Pub. Date: Nov. 12, 2020

(65) Prior Publication Data
US 2020/0357341 A1 Nov. 12, 2020

(51) Int. Cl.
*G09G 3/3266* (2016.01)

(52) U.S. Cl.
CPC ... *G09G 3/3266* (2013.01); *G09G 2310/0291* (2013.01); *G09G 2310/08* (2013.01)

(58) Field of Classification Search
CPC ..... G09G 3/3266; G09G 2310/0291; G09G 2310/08; G09G 2310/0286; G09G 2310/0289; G11C 29/20
See application file for complete search history.

(56) References Cited

U.S. PATENT DOCUMENTS 8,860,651 B2 * 10/2014 Tseng ..... G11C 19/28 345/100
2008/0048712 A1 * 2/2008 Ahn ..... H03K 17/161 326/21
2008/0067511 A1 3/2008 Kim
2008/0266275 A1 * 10/2008 Tsai ..... G09G 3/3677 345/204
2014/0035889 A1 * 2/2014 Huang ..... G09G 3/00 345/204
2014/0111503 A1 4/2014 Kwon et al.
(Continued)

FOREIGN PATENT DOCUMENTS

CN 101078848 11/2007
CN 104282279 1/2015
(Continued)

*Primary Examiner* — Roberto W Flores

(57) ABSTRACT

The present invention discloses a driving circuit of display device, including an output module, a signal amplification module, a plurality of signal conversion modules, a plurality of column scanning signals. The output module is used for providing a plurality of scanning signals for displaying. The signal amplification module is used for amplifying the plurality of scanning signals. The plurality of signal conversion modules are used for converting each of the plurality of amplified scanning signals into at least two column scanning signals. The plurality of column scanning signals are used for transferring the plurality of column scanning signals to a display control circuit of display device.

13 Claims, 4 Drawing Sheets

(56) References Cited

U.S. PATENT DOCUMENTS

| | | | | |
|---|---|---|---|---|
| 2014/0159997 | A1* | 6/2014 | Chen | G09G 3/3611 345/87 |
| 2015/0221265 | A1* | 8/2015 | Huang | G09G 3/3696 345/690 |
| 2016/0240145 | A1* | 8/2016 | Jeong | G06F 1/04 |
| 2016/0253950 | A1 | 9/2016 | Ma | |
| 2016/0284295 | A1 | 9/2016 | Dai | |
| 2017/0229083 | A1* | 8/2017 | Du | G09G 3/36 |
| 2017/0236480 | A1* | 8/2017 | Dai | G11C 19/28 345/213 |
| 2017/0358267 | A1* | 12/2017 | Feng | G09G 3/3648 |
| 2020/0066203 | A1* | 2/2020 | Kim | G09G 3/3233 |
| 2020/0219428 | A1* | 7/2020 | Yuan | G09G 3/3677 |

FOREIGN PATENT DOCUMENTS

| | | |
|---|---|---|
| CN | 107331361 | 11/2017 |
| CN | 109559698 | 4/2019 |
| CN | 109712552 | 5/2019 |

* cited by examiner

DRIVING CIRCUIT OF DISPLAY DEVICE

RELATED APPLICATIONS

This application is a National Phase of PCT Patent Application No. PCT/CN2019/099700 having International filing date of Aug. 8, 2019, which claims the benefit of priority of Chinese Patent Application No. 201910370661.6 filed on May 6, 2019. The contents of the above applications are all incorporated by reference as if fully set forth herein in their entirety.

FIELD AND BACKGROUND OF THE INVENTION

The disclosure relates to a display technology field, and more particularly to a driving circuit of display device.

At present, horizontal scanning lines of an organic light-emitting diode display panel are driven by an external integrated circuit. The external integrated circuit can control charging and discharging of the column scanning lines at all stages. Gate driver on array (GOA) can integrate the driving circuit of the column scanning lines into the array substrate of the display panel, so that the usage of external integrated circuit is obviously decreasing. The GOA can reduce the production cost and power consumption of the display panel, and reduce frame width of a display device.

SUMMARY OF THE INVENTION

Indium gallium zinc oxide (IGZO) thin film transistors have high mobility and good stability, but the threshold voltage is prone to negative-going drift. In order to inhibit the negative-going drifting of threshold voltage, a plurality of thin film transistors is required, which results in a complicated design of the driving circuit of the display screen using the IGZO and being disadvantageous for reducing the width of the frame of the display panel.

Therefore, optimization of the driving circuit of the display screen using the IGZO is necessary, which can reduce the space occupied by the GOA circuit layout.

The object of the present disclosure is to provide a driving circuit of display device to reduce the space occupied by driving circuit and the width of the frame of the display panel.

To achieve the above object, the present disclosure provides a driving circuit of display device, comprising: an output module, comprising a signal main line and a signal output sub-module, and the output module is used for providing a plurality of scanning signals for displaying, the plurality of scanning signals are cascaded; a signal amplification module, the signal amplification module is used for amplifying the plurality of scanning signals; a plurality of signal conversion modules, corresponding one-to-one to the plurality of amplified scanning signals, the plurality of signal conversion modules are used for converting each of the plurality of amplified scanning signals into at least two column scanning signals; and a plurality of column scanning signals, corresponding one-to-one to the plurality of scanning signals, and the plurality of column scanning signals are used for transferring the plurality of column scanning signals to a display control circuit of the display device.

According to one aspect of the present disclosure, the signal conversion modules comprise at least two secondary clock signals, the plurality of secondary clock signals have a same period and duty ratio; wherein, a sum of pulse widths of the plurality of secondary clock signals are same as a pulse width of the plurality of amplified scanning signals.

According to one aspect of the present disclosure, the number of the plurality of secondary clock signals are same as the number of the column scanning signals.

According to one aspect of the present disclosure, each of the signal conversion modules at least comprises a first signal conversion unit and a second signal conversion unit; the first signal conversion unit comprises a first conversion thin film transistor and a second conversion thin film transistor; wherein a source of the first conversion thin film transistor is connected to a first secondary clock signal, a gate of the first conversion thin film transistor is connected to an output terminal of the signal amplification module, a drain of the first conversion thin film transistor is connected to a source of the second conversion thin film transistor and outputs a first column scanning signal; a gate of the second conversion thin film transistor is connected to a second secondary clock signal, a drain of the second conversion thin film transistor is connected to a third DC voltage; the second signal conversion unit comprises a third conversion thin film transistor and a fourth conversion thin film transistor; wherein a source of the third conversion thin film transistor is connected to the second secondary clock signal, a gate of the third conversion thin film transistor is connected to an output terminal of the signal amplification module, a drain of the third of the conversion thin film transistor is connected to a source of the fourth conversion thin film transistor and outputs a second column scanning signal; and a gate of the fourth conversion thin film transistor is connected to a third secondary clock signal, a drain of the fourth conversion thin film transistor is connected to the third DC voltage.

According to one aspect of the present disclosure, each of the signal conversion modules comprises a third signal conversion unit, the third signal conversion unit comprises a fifth conversion thin film transistor and a sixth conversion thin film transistor; wherein a source of the fifth conversion thin film transistor is connected to the third secondary clock signal, a gate of the fifth conversion thin film transistor is connected to an output terminal of the signal amplification module, a drain of the fifth of the conversion thin film transistor is connected to a source of the sixth conversion thin film transistor and outputs a third column scanning signal; a gate of the sixth conversion thin film transistor is connected to the first secondary clock signal, a drain of the sixth conversion thin film transistor is connected to the third DC voltage.

According to one aspect of the present disclosure, the signal amplifying module comprise: a pull-up unit, the pull-up unit is used for converting a clock signal to a stage-by-stage transmission signal and converting a DC voltage signal to an output signal; a pull-up control unit, the pull-up control unit is used for controlling an opening time of the pull-up unit;

a bootstrap capacitor, the bootstrap capacitor is used for uplifting the stage-by-stage transmission signal and outputting a signal voltage; a pull-down unit, the pull-down unit is used for descending an output voltage of the bootstrap capacitor to a low voltage; a pull-down maintenance unit, the pull-down maintenance unit is used for keeping the output voltage of the bootstrap capacitor in a low voltage; an Inverter, the inverter is used for making the output voltage of the bootstrap capacitor be opposite to the output voltage of the pull-down maintenance unit; and a feedback unit, the feedback unit is used for uplifting the output voltage of the pull-down unit.

According to one aspect of the present disclosure, the pull-up unit comprises a first pull-up unit and a second pull-up unit; the first pull-up unit comprises a first pull-up thin film transistor and a second pull-up thin film transistor; wherein a source of the first pull-up thin film transistor is connected to a first DC voltage, a drain of the first pull-up thin film transistor is connected to one of electrode plate of the bootstrap capacitor, a gate of the first pull-up thin film transistor is connected to a gate of the second pull-up thin film transistor; a source of the second pull-up thin film transistor is connected to the first DC voltage, a gate of the second pull-up thin film transistor is connected to another electrode plate of the bootstrap capacitor, a gate of the first pull-up thin film transistor is connected to a last stage-by-stage transmission signal; the second pull-up unit comprises a third pull-up thin film transistor, a source of the third pull-up thin film transistor is connected to a second clock signal, a gate of the third pull-up thin film transistor is connected to the one of electrode plate of the bootstrap capacitor, a drain of the third pull-up thin film transistor is connected to another electrode plate of the bootstrap capacitor.

According to one aspect of the present disclosure, the pull-up control unit comprises a first control thin film transistor and a second control thin film transistor; wherein a source of the first control thin film transistor is connected to the last stage-by-stage transmission signal, a gate of the first control thin film transistor is connected to a first clock signal, a drain of the first control thin film transistor is connected to a source of the second control thin film transistor; a gate of the second control thin film transistor is connected to the first clock signal, a drain of the second control thin film transistor is connected to the pull-down maintenance unit.

According to one aspect of the present disclosure, the pull-down unit comprises a first pull-down unit and a second pull-down unit; wherein the first pull-down unit comprises a first pull-down thin film transistor, a source of the first pull-down thin film transistor is connected to the first pull-up unit, a gate of the first pull-down thin film transistor is connected to a next stage-by-stage transmission signal, a drain of the first pull-down thin film transistor is connected to the third DC voltage; the second pull-down unit comprises a second pull-down thin film transistor and a third pull-down thin film transistor; a source of the second pull-down thin film transistor is connected to the second pull-up unit, a gate of the second pull-down thin film transistor is connected to a next stage-by-stage transmission signal, a drain of the second pull-down thin film transistor is connected to a source of the third pull-down thin film transistor; a gate of the third pull-down thin film transistor is connected to a next stage-by-stage transmission signal, a drain of the third pull-down thin film transistor is connected to the third DC voltage.

According to one aspect of the present disclosure, the inverter comprises a first inverter and a second inverter; wherein the first inverter comprises a first inverse thin film transistor, a second inverse thin film transistor, a third inverse thin film transistor and a fourth inverse thin film transistor; a source and a gate of the first inverse thin film transistor is connected to the second pull-down unit, a drain of the first inverse thin film transistor is connected to a source of the second inverse thin film transistor; a gate of the second inverse thin film transistor is connected to the second pull-down unit, a drain of the second inverse thin film transistor is connected to the third DC voltage; a source of the third inverse thin film transistor is connected to the second pull-down unit, a gate of the third inverse thin film transistor is connected to the drain of the first inverse thin film transistor, a drain of the third inverse thin film transistor is connected to a source of the fourth inverse thin film transistor; a gate of the fourth inverse thin film transistor is connected to the gate of the second inverse thin film transistor, a drain of the fourth inverse thin film transistor is connected to the third DC voltage; the second inverter comprises a fifth inverse thin film transistor, a sixth inverse thin film transistor, a seventh inverse thin film transistor and an eighth inverse thin film transistor; a source and a gate of the fifth inverse thin film transistor is connected to the feedback unit, a drain of the fifth inverse thin film transistor is connected to a source of the sixth inverse thin film transistor; a gate of the sixth inverse thin film transistor is connected to the second pull-up unit, a drain of the sixth inverse thin film transistor is connected to the third DC voltage; a source a of the seventh inverse thin film transistor is connected to the feedback unit, a gate of the seventh inverse thin film transistor is connected to the drain of the fifth inverse thin film transistor, a drain of the seventh inverse thin film transistor is connected to a source of the eighth inverse thin film transistor; a gate of the eighth inverse thin film transistor is connected to the gate of the sixth inverse thin film transistor, a drain of the eighth inverse thin film transistor is connected to the third DC voltage.

According to one aspect of the present disclosure, the feedback unit comprises a feedback thin film transistor, a source of the feedback thin film transistor is connected to the first pull-up unit, a drain of the feedback thin film transistor is connected to the pull-up control unit, a gate of the feedback thin film transistor is connected to a present stage-by-stage transmission signal.

According to one aspect of the present disclosure, the bootstrap capacitor comprises a first storage capacitor and a second storage capacitor; wherein one of electrode plate of the first storage capacitor is connected to the first pull-up unit, another electrode plate of the first storage capacitor is connected to the first pull-down maintenance unit; one of electrode plate of the second storage capacitor is connected to the second pull-up unit, another electrode plate of the second storage capacitor is connected to the second pull-down maintenance unit.

According to one aspect of the present disclosure, each of the signal conversion modules at least comprises a first signal conversion unit and a second signal conversion unit; the first signal conversion unit comprises a first conversion thin film transistor and a second conversion thin film transistor; wherein a source of the first conversion thin film transistor is connected to a first secondary clock signal, a gate of the first conversion thin film transistor is connected to an output terminal of the signal amplification module, a drain of the first conversion thin film transistor is connected to a source of the second conversion thin film transistor and outputs a first column scanning signal; a gate of the second conversion thin film transistor is connected to a second secondary clock signal, a drain of the second conversion thin film transistor is connected to a third DC voltage; the second signal conversion unit comprises a third conversion thin film transistor and a fourth conversion thin film transistor; wherein a source of the third conversion thin film transistor is connected to the second secondary clock signal, a gate of the third conversion thin film transistor is connected to an output terminal of the signal amplification module, a drain of the third of the conversion thin film transistor is connected to a source of the fourth conversion thin film transistor and outputs a second column scanning signal; a gate of the fourth conversion thin film transistor is connected to a third secondary clock signal, a drain of the fourth conversion thin film transistor is connected to the third DC voltage.

According to one aspect of the present disclosure, each of the signal conversion modules comprises a third signal conversion unit, comprising a fifth conversion thin film transistor and a sixth conversion thin film transistor; wherein a source of the fifth conversion thin film transistor is connected to the third secondary clock signal, a gate of the fifth conversion thin film transistor is connected to an output terminal of the signal amplification module, a drain of the fifth of the conversion thin film transistor is connected to a source of the sixth conversion thin film transistor and outputs a third column scanning signal; a gate of the sixth conversion thin film transistor is connected to the first secondary clock signal, a drain of the sixth conversion thin film transistor is connected to the third DC voltage.

In the present disclosure, driving circuit can drive three column scanning lines, which greatly reduces the space occupied by driving circuit and furthermore reduces the width of the frame of the display panel.

DESCRIPTION OF SPECIFIC EMBODIMENTS OF THE INVENTION

The following description of the embodiments with reference to the appended drawings is used for illustrating specific embodiments which may be used for carrying out the present disclosure. The directional terms described by the present disclosure, such as "upper", "lower", "front", "back", "left", "right", "inner", "outer", "side", etc., are only directions by referring to the accompanying drawings. Thus, the used directional terms are used to describe and understand the present disclosure, but the present disclosure is not limited thereto. In figures, elements with similar structures are indicated by the same numbers.

Figure 1:
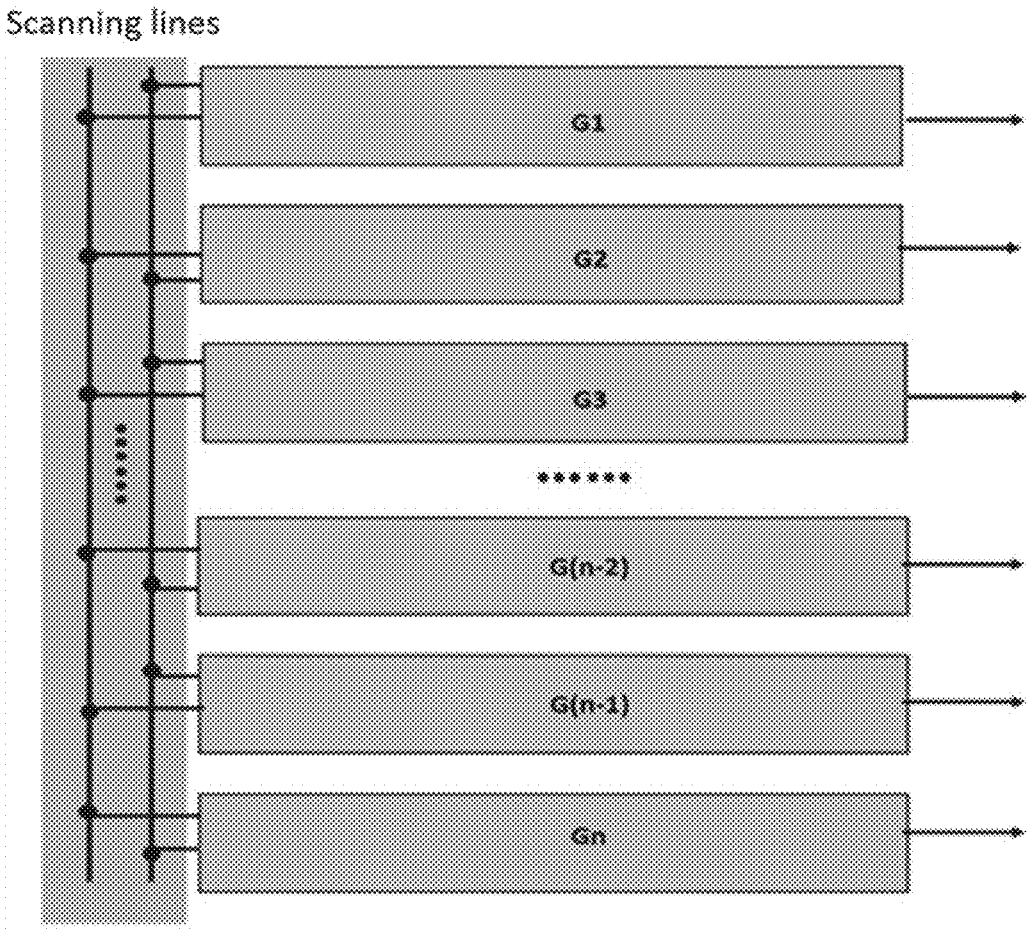
FIG. 1 is a schematic view of structure of driving circuit of display device of the prior art.

Referring to FIG. 1, FIG. 1 is a schematic view of structure of driving circuit of display device of the prior art. The driving circuit of the prior art is an architecture which is the first-stage driving circuit drives the first-stage column scanning lines, and the area occupied by the design architecture is too large, which is disadvantageous for reducing the width of the frame of the display panel.

Figure 2:
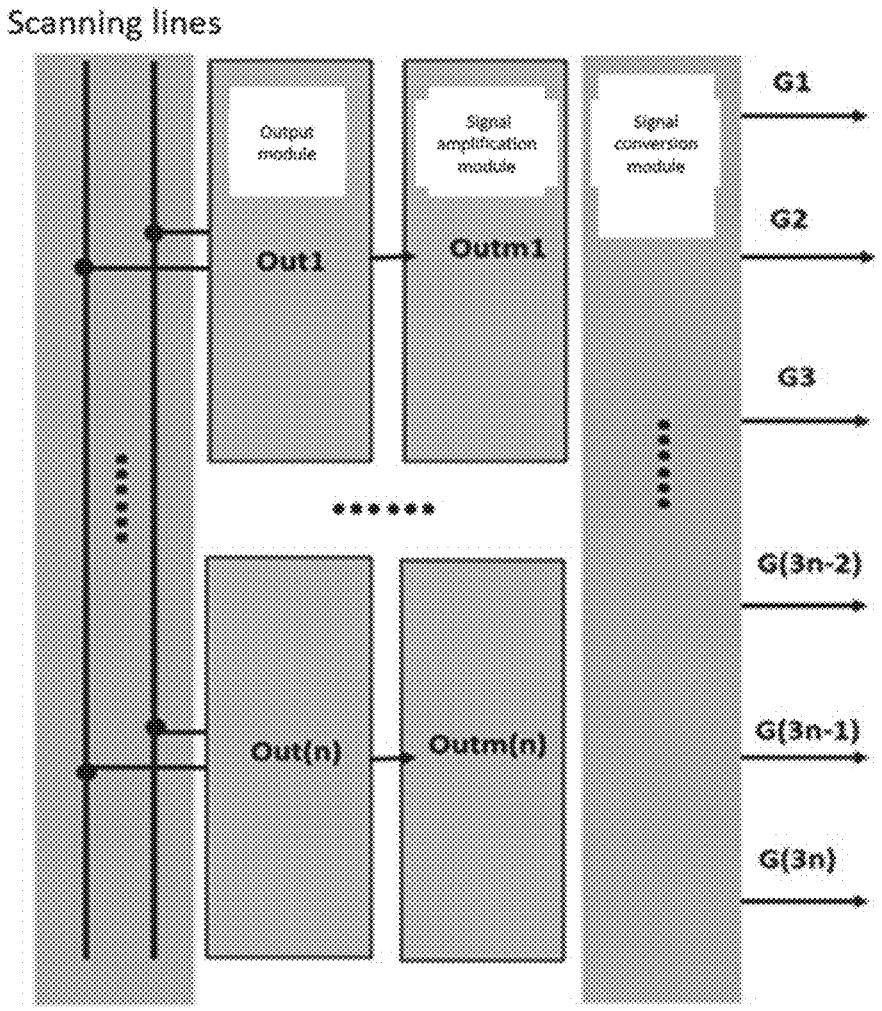
FIG. 2 is a schematic view of structure of driving circuit for driving display device in accordance with one embodiment of the present disclosure.

Referring to FIG. 2, FIG. 2 is a schematic view of structure of driving circuit for driving display device in accordance with one embodiment of the present disclosure. As shown as FIG. 2, in the driving circuit of present disclosure, the first-stage driving circuit can drive the third-stage column scanning lines, which greatly reduces the area occupied by the driving circuit.

Referring to FIG. 2 in more detail, the driving circuit comprises an output module, comprising a signal main line and a signal output sub-module, and the output module is used for providing a plurality of scanning signals for displaying, the plurality of scanning signals are cascaded. A signal amplification module, the signal amplification module is used for amplifying the plurality of scanning signals. A plurality of signal conversion modules, corresponding one-to-one to the plurality of amplified scanning signals, the plurality of signal conversion modules are used for converting each of the plurality of amplified scanning signals into at least two column scanning signals. A plurality of column scanning signals, corresponding one-to-one to the plurality of scanning signals, and the plurality of column scanning signals are used for transferring the plurality of column scanning signals to a display control circuit of the display device.

The signal conversion modules comprise at least two secondary clock signals, the plurality of secondary clock signals have a same period and duty ratio, and the number of the plurality of secondary clock signals are same as the number of the column scanning signals. Wherein, a sum of pulse widths of the plurality of secondary clock signals are same as a pulse width of the plurality of amplified scanning signals.

Figure 6:
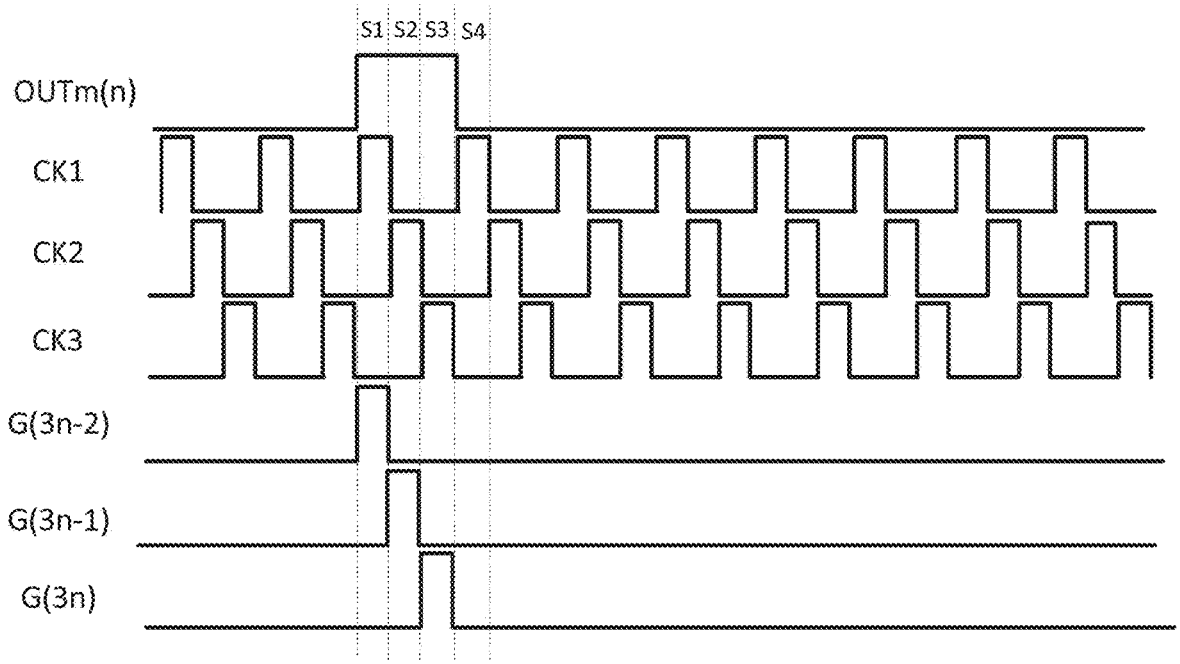
FIG. 6 is a timing diagram between the secondary clock signal and the column scanning signal of output.

Referring to FIG. 6, FIG. 6 is a timing diagram between the secondary clock signal and the column scanning signal of output. As shown as FIG. 6, in the present embodiment, the number of the secondary clock signal is three, the sum of the pulse widths of the three secondary clock signals is same as a pulse width of the plurality of amplified scanning signals.

Figure 4:
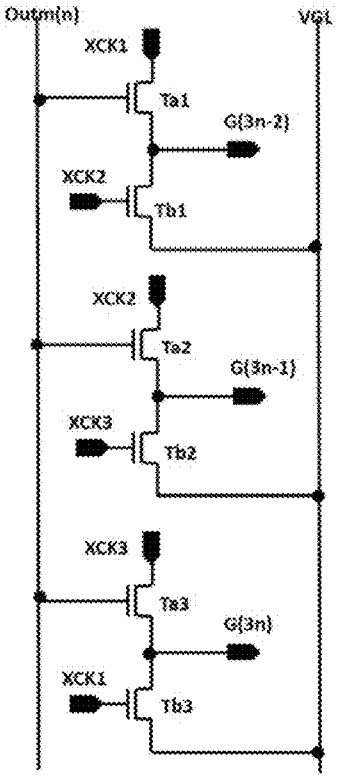
FIG. 4 is a circuit diagram of driving circuit of signal conversion module in accordance with one embodiment of the present disclosure.

Referring to FIG. 4, FIG. 4 is a circuit diagram of driving circuit of signal conversion module in accordance with one embodiment of the present disclosure. Wherein, each of the signal conversion modules at least comprises a first signal conversion unit and a second signal conversion unit. The first signal conversion unit comprises a first conversion thin film transistor Ta1 and a second conversion thin film transistor Ta2. Wherein, a source of the first conversion thin film transistor Ta1 is connected to a first secondary clock signal, a gate of the first conversion thin film transistor Ta1 is connected to an output terminal of the signal amplification module, a drain of the first conversion thin film transistor Ta1 is connected to a source of the second conversion thin film transistor Ta2 and outputs a first column scanning signal. A gate of the second conversion thin film transistor Ta2 is connected to a second secondary clock signal, a drain of the second conversion thin film transistor Ta2 is connected to a third DC voltage.

The second signal conversion unit comprises a third conversion thin film transistor Ta3 and a fourth conversion thin film transistor Ta4. Wherein, a source of the third conversion thin film transistor Ta3 is connected to the second secondary clock signal, a gate of the third conversion thin film transistor Ta3 is connected to an output terminal of the signal amplification module, a drain of the third of the conversion thin film transistor Ta3 is connected to a source of the fourth conversion thin film transistor Ta4 and outputs a second column scanning signal. A gate of the fourth conversion thin film transistor Ta4 is connected to a third secondary clock signal, and a drain of the fourth conversion thin film transistor Ta4 is connected to the third DC voltage.

Preferably, each of the signal conversion modules comprises a third signal conversion unit, the third signal conversion unit comprises a fifth conversion thin film transistor Ta5 and a sixth conversion thin film transistor Ta6. Wherein, a source of the fifth conversion thin film transistor Ta5 is connected to the third secondary clock signal, a gate of the fifth conversion thin film transistor Ta5 is connected to an output terminal of the signal amplification module, a drain of the fifth of the conversion thin film transistor Ta5 is connected to a source of the sixth conversion thin film transistor Ta6 and outputs a third column scanning signal. A gate of the sixth conversion thin film transistor Ta6 is connected to the first secondary clock signal, a drain of the sixth conversion thin film transistor Ta6 is connected to the third DC voltage.

Figure 3:
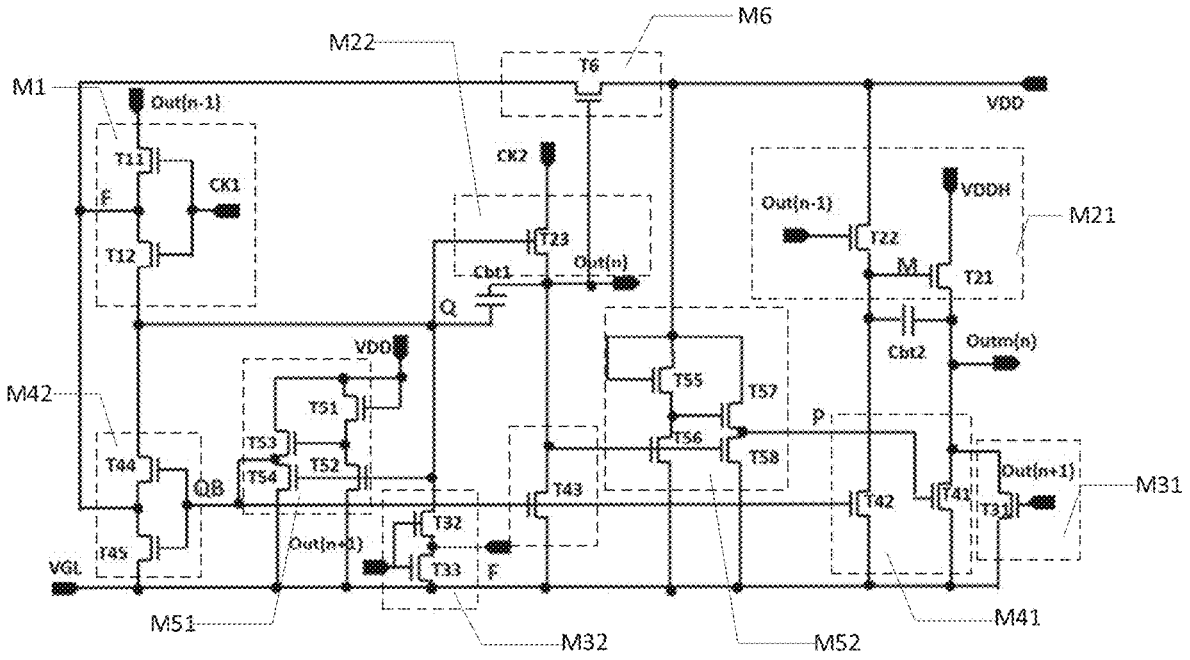
FIG. 3 is a circuit diagram of driving circuit of signal amplification module in accordance with one embodiment of the present disclosure.

In the present embodiment, referring to FIG. 3, FIG. 3 is a circuit diagram of driving circuit of signal amplification module in accordance with one embodiment of the present disclosure. Wherein, the signal amplifying module comprise: a pull-up unit M2, the pull-up unit M2 is used for converting a clock signal to a stage-by-stage transmission signal and converting a DC voltage signal to an output signal; a pull-up control unit M1, the pull-up control unit M1 is used for controlling an opening time of the pull-up unit M2; a bootstrap capacitor, the bootstrap capacitor is used for uplifting the stage-by-stage transmission signal and outputting a signal voltage; a pull-down unit M3, the pull-down unit M3 is used for descending an output voltage of the bootstrap capacitor to a low voltage; a pull-down maintenance unit M4, the pull-down maintenance unit M4 is used for keeping the output voltage of the bootstrap capacitor in a low voltage; an Inverter M5, the inverter M5 is used for making the output voltage of the bootstrap capacitor be opposite to the output voltage of the pull-down maintenance unit; and a feedback unit M6, the feedback unit is used for uplifting the output voltage of the pull-down unit M3.

In the present embodiment, the pull-up unit M2 comprises a first pull-up unit M21 and a second pull-up unit M22.

The first pull-up unit M21 comprises a first pull-up thin film transistor T21 and a second pull-up thin film transistor T22. Wherein, a source of the first pull-up thin film transistor T21 is connected to a first DC voltage, a drain of the first pull-up thin film transistor T21 is connected to one of electrode plate of the bootstrap capacitor, a gate of the first pull-up thin film transistor T21 is connected to another electrode plate of the bootstrap capacitor. A source of the second pull-up thin film transistor T22 is connected to the first DC voltage, a drain of the second pull-up thin film transistor T22 is connected to the another electrode plate of the bootstrap capacitor, a gate of the first pull-up thin film transistor is connected to a last stage-by-stage transmission signal.

The second pull-up unit M22 comprises a third pull-up thin film transistor, a source of the third pull-up thin film transistor is connected to a second clock signal, a gate of the third pull-up thin film transistor is connected to the one of electrode plate of the bootstrap capacitor, a drain of the third pull-up thin film transistor is connected to another electrode plate of the bootstrap capacitor.

The pull-up control unit M1 comprises a first control thin film transistor T11 and a second control thin film transistor T12. Wherein, a source of the first control thin film transistor T11 is connected to the last stage-by-stage transmission signal, a gate of the first control thin film transistor T11 is connected to a first clock signal, a drain of the first control thin film transistor T11 is connected to a source of the second control thin film transistor T12; a gate of the second control thin film transistor T12 is connected to the first clock signal, a drain of the second control thin film transistor T12 is connected to the pull-down maintenance unit M4.

The first control thin film transistor T11 and the second control thin film transistor T12 are N-type thin film transistor.

The pull-down unit M3 comprises a first pull-down unit M31 and a second pull-down unit M32. Wherein, the first pull-down unit M31 comprises a first pull-down thin film transistor T31, a source of the first pull-down thin film transistor T31 is connected to the first pull-up unit M21, a gate of the first pull-down thin film transistor T31 is connected to a next stage-by-stage transmission signal, a drain of the first pull-down thin film transistor is connected to the third DC voltage VGL. The second pull-down unit M32 comprises a second pull-down thin film transistor T32 and a third pull-down thin film transistor T33, a source of the second pull-down thin film transistor T32 is connected to the second pull-up unit M32, a gate of the second pull-down thin film transistor is connected to a next stage-by-stage transmission signal, a drain of the second pull-down thin film transistor T32 is connected to a source of the third pull-down thin film transistor T33. A gate of the third pull-down thin film transistor T33 is connected to a next stage-by-stage transmission signal, a drain of the third pull-down thin film transistor T33 is connected to the third DC voltage VGL.

Preferably, the first pull-down thin film transistor T31 and the third pull-down thin film transistor T33 are N-type thin film transistor, the second pull-down thin film transistor T32 is P-type thin film transistor.

The pull-down maintenance unit M4 comprises a first pull-down maintenance unit M41 and a second pull-down maintenance unit M42. Wherein, the first pull-down maintenance unit M41 comprises a first pull-down maintenance thin film transistor T41 and a second pull-down maintenance thin film transistor T42. A source of the first pull-down maintenance thin film transistor T41 is connected to the first pull-up unit M21, a gate of the first pull-down maintenance thin film transistor T41 is connected to the inverter, a drain of the first pull-down maintenance thin film transistor is connected to the third DC voltage VGL. A source of the second pull-down maintenance thin film transistor T42 is connected to the second pull-up unit M22, a drain of the first pull-down maintenance thin film transistor T42 is connected to the third DC voltage VGL. The second pull-down maintenance unit M32 comprises a fourth pull-down maintenance thin film transistor T44 and a fifth pull-down maintenance thin film transistor T45, a source of the fourth pull-down maintenance thin film transistor T44 is connected to the pull-up control unit M1, a gate of the forth pull-down maintenance thin film transistor T44 is connected to the inverter M5, a drain of the fourth pull-down maintenance thin film transistor T44 is connected to a source of the fifth pull-down maintenance thin film transistor T45. A gate of the fifth pull-down maintenance thin film transistor T45 is connected to the inverter M5, a drain of the fifth pull-down thin film transistor T45 is connected to the third DC voltage VGL.

The inverter M5 comprises a first inverter M51 and a second inverter M52.

Wherein, the first inverter M51 comprises a first inverse thin film transistor T51, a second inverse thin film transistor T52, a third inverse thin film transistor T53 and a fourth inverse thin film transistor T54. A source and a gate of the first inverse thin film transistor T51 is connected to the second pull-down unit M32, a drain of the first inverse thin film transistor T51 is connected to a source of the second inverse thin film transistor T52. A gate of the second inverse thin film transistor T52 is connected to the second pull-down unit M32, a drain of the second inverse thin film transistor T52 is connected to the third DC voltage VGL. A source of the third inverse thin film transistor T53 is connected to the second pull-down unit M32, a gate of the third inverse thin film transistor T53 is connected to the drain of the first inverse thin film transistor T51, a drain of the third inverse thin film transistor T53 is connected to a source of the fourth inverse thin film transistor T54. A gate of the fourth inverse thin film transistor T54 is connected to the gate of the second inverse thin film transistor T52, a drain of the fourth inverse thin film transistor T54 is connected to the third DC voltage VGL.

The second inverter M52 comprises a fifth inverse thin film transistor T55, a sixth inverse thin film transistor T56, a seventh inverse thin film transistor T57 and an eighth inverse thin film transistor T58. A source and a gate of the fifth inverse thin film transistor T55 is connected to the feedback unit M6, a drain of the fifth inverse thin film transistor T55 is connected to a source of the sixth inverse thin film transistor T56. A gate of the sixth inverse thin film transistor T56 is connected to the second pull-up unit M22, a drain of the sixth inverse thin film transistor T56 is connected to the third DC voltage VGL. A source a of the seventh inverse thin film transistor T57 is connected to the feedback unit M6, a gate of the seventh inverse thin film transistor T57 is connected to the drain of the fifth inverse thin film transistor T55, a drain of the seventh inverse thin film transistor T57 is connected to a source of the eighth inverse thin film transistor T58. A gate of the eighth inverse thin film transistor T58 is connected to the gate of the sixth inverse thin film transistor T56, a drain of the eighth inverse thin film transistor T58 is connected to the third DC voltage VGL.

The feedback unit M6 comprises a feedback thin film transistor T6, a source of the feedback thin film transistor T6 is connected to the first pull-up unit M21, a drain of the feedback thin film transistor T6 is connected to the pull-up control unit M1, a gate of the feedback thin film transistor T6 is connected to a present stage-by-stage transmission signal.

The bootstrap capacitor comprises a first storage capacitor Cbt1 and a second storage capacitor Cbt2. Wherein, one of electrode plate of the first storage capacitor Cbt1 is connected to the first pull-up unit M21, another electrode plate of the first storage capacitor Cbt1 is connected to the first pull-down maintenance unit M4. One of electrode plate of the second storage capacitor Cbt2 is connected to the second pull-up unit M22, another electrode plate of the second storage capacitor Cbt2 is connected to the second pull-down maintenance unit M32.

Each of the signal conversion modules at least comprises a first signal conversion unit, a second signal conversion unit and a third signal conversion unit.

The first signal conversion unit comprises a first conversion thin film transistor Ta1 and a second conversion thin film transistor Ta2. Wherein, a source of the first conversion thin film transistor Ta1 is connected to a first secondary clock signal, a gate of the first conversion thin film transistor Ta1 is connected to an output terminal of the signal amplification module, a drain of the first conversion thin film transistor Ta1 is connected to a source of the second conversion thin film transistor Ta2 and outputs a first column scanning signal. A gate of the second conversion thin film transistor Ta2 is connected to a second secondary clock signal, a drain of the second conversion thin film transistor Ta2 is connected to a third DC voltage VGL The second signal conversion unit comprises a third conversion thin film transistor Ta3 and a fourth conversion thin film transistor Ta4. Wherein, a source of the third conversion thin film transistor Ta3 is connected to the second secondary clock signal, a gate of the third conversion thin film transistor Ta3 is connected to an output terminal of the signal amplification module, a drain of the third of the conversion thin film transistor Ta3 is connected to a source of the fourth conversion thin film transistor Ta4 and outputs a second column scanning signal. A gate of the fourth conversion thin film transistor Ta4 is connected to a third secondary clock signal, a drain of the fourth conversion thin film transistor is connected to the third DC voltage.

The third signal conversion unit comprises a fifth conversion thin film transistor Ta5 and a sixth conversion thin film transistor Ta6. Wherein, a source of the fifth conversion thin film transistor is connected to the third secondary clock signal, a gate of the fifth conversion thin film transistor Ta5 is connected to an output terminal of the signal amplification module, a drain of the fifth of the conversion thin film transistor Ta5 is connected to a source of the sixth conversion thin film transistor Ta6 and outputs a third column scanning signal. A gate of the sixth conversion thin film transistor Ta6 is connected to the first secondary clock signal, a drain of the sixth conversion thin film transistor Ta6 is connected to the third DC voltage.

Figure 5:
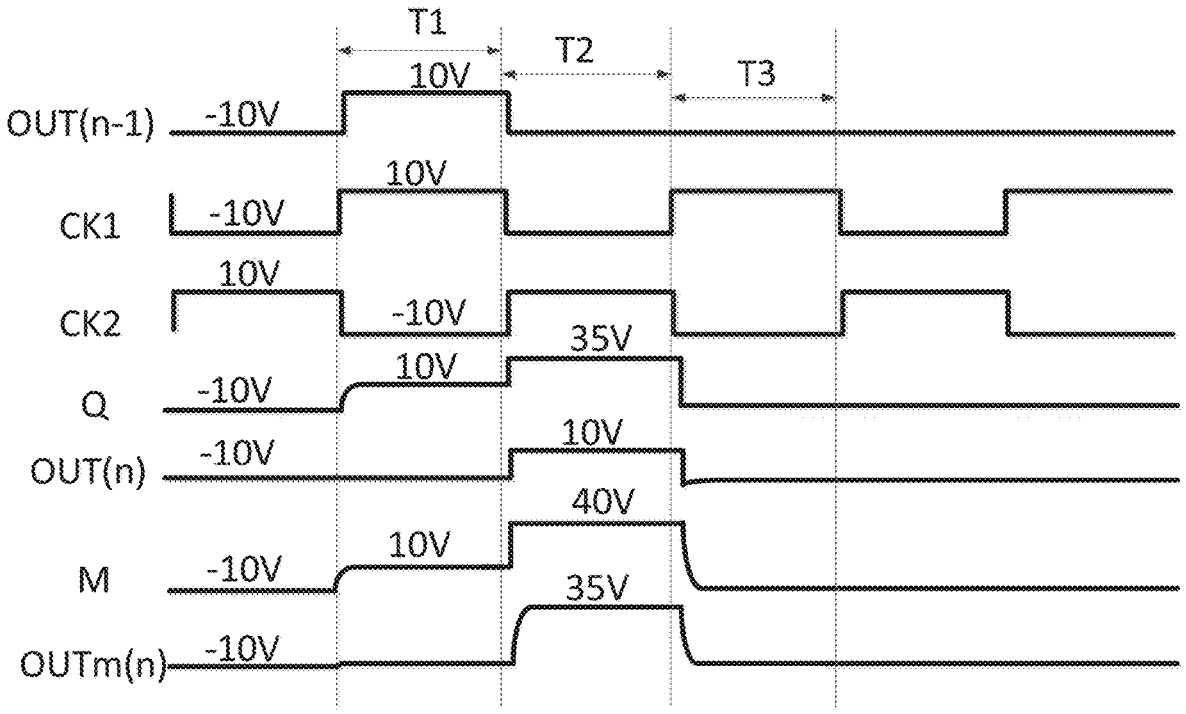
FIG. 5 is a schematic of simulation results of driving circuit in accordance with one embodiment of the present disclosure.

The operational principle of driving circuit of the present disclosure is described in detail more fully hereinafter with reference to the combined specific embodiment. Referring to FIG. 5 and FIG. 6, FIG. 5 is a schematic of simulation results of driving circuit in accordance with one embodiment of the present disclosure. FIG. 6 is a timing diagram between the secondary clock signal and the column scanning signal of output.

Wherein, CK1 is a first clock signal, CK2 is a second clock signal, the waveform of first clock signal CK1 is opposite to the second clock signal CK2. XCK1 is a first secondary clock signal, XCK2 is a second secondary clock signal, XCK3 is third secondary clock signal. OUTm(n) is the output signal of present stage. OUT(n) is the stage-by-stage transmission signal of present stage; OUT(n−1) is the stage-by-stage transmission signal of last stage; OUT(n+1) is the stage-by-stage transmission signal of next stage.

Referring FIG. 3, the duty ratio of driving circuit comprises a first stage T1, a second stage T2 and a third stage T3 in the present disclosure.

In the first stage: when the first clock signal CK1 is at high voltage, the first control thin film transistor T11 and the second control thin film transistor T12 are conductive, OUT(n−1) is high voltage, the node Q is uplifted to high voltage, the fourth pull-up thin film transistor T24, the second inverse thin film transistor T52 and the fourth inverse thin film transistor T54 are conducive, the node QB is descended to low voltage, the third maintenance thin film transistor T43, the fourth maintenance thin film transistor T44, the fifth maintenance thin film transistor T45 and the sixth maintenance thin film transistor T46 are non-conductive. Since the second clock signal is low voltage, the stage-by-stage transmission signal of present stage OUT(n) is low voltage, the sixth inverse thin film transistor T56 and the eighth inverse thin film transistor T58 are non-conductive, the node P is uplifted to high voltage, the first maintenance thin film transistor T41 and the second maintenance thin film transistor T42 are conductive, the stage-by-stage transmission signal of last stage OUT(n−1) is high voltage, the third pull-up thin film transistor T23 is conductive, the node M is descended to high voltage, the first pull-up thin film transistor T21 and the second pull-up thin film transistor T22 are conductive, since the second maintenance thin film transistor T42 and the first maintenance thin film transistor T41 are conductive, the node N and the amplified signal Outm(n) still maintain at low voltage.

In the second stage: when the first clock signal CK1 is at low voltage, the first control thin film transistor T11 and the second control thin film transistor T12 are non-conductive, the fourth pull-up thin film transistor T24 is conductive, CK2 changes to high voltage, the stage-by-stage transmission signal OUT(n) changes to high voltage, thus, the voltage of node Q is uplifted to higher voltage, which is advantageous for the fourth pull-up thin film transistor T24 conducting. At the same time, the inverse thin film transistor T6, the sixth inverse thin film transistor T56 and the eighth inverse thin film transistor T58 are conductive, the node F is uplifted to high voltage, which is advantageous for reducing the second control thin film transistor T12. The fifth maintenance thin film transistor T45 and the second pull-down thin film transistor T32 discharge to keep the voltage of node Q. The node P is descended to low voltage. The first maintenance thin film transistor T41 and the second maintenance thin film transistor T42 are non-conductive, the node N is uplifted to high voltage. Since there is a second storage capacitor Cbr2, the node M is uplifted to higher voltage. The first pull-up thin film transistor T21 and the second pull-up thin film transistor T22 are conductive, the voltage of node N and output signal are gradually uplifted to high voltage. The amplified signal Outm(n) is uplifted high voltage.

In the third stage: the first clock signal CK1 is at high voltage, the first control thin film transistor T11 and the second control thin film transistor T12 are conductive, since the stage-by-stage transmission signal of last stage OUT(n–1) is low voltage, the node Q is descended to low voltage, the fourth pull-up thin film transistor T24, the second inverse thin film transistor T52 and the fourth inverse thin film transistor T54 are non-conducive, the node QB is uplifted to high voltage. The third maintenance thin film transistor T43, the fourth maintenance thin film transistor T44, the fifth maintenance thin film transistor T45 and the sixth maintenance thin film transistor T46 are conductive, the stage-by-stage transmission signal OUT(n) is descended to low voltage. The sixth inverse thin film transistor T56, the eighth inverse thin film transistor T58 and the inverse thin film transistor T6 are non-conductive, the node P is uplifted to high voltage. The first maintenance thin film transistor T41 and the second maintenance thin film transistor T42 are conductive, the stage-by-stage transmission signal of next stage OUT(n+1) is uplifted to high voltage. The first pull-down thin film transistor T31 is conductive, the stage-by-stage transmission signal Out(n) and the amplified signal is descended to low voltage.

In driving circuit of the present disclosure, the driving circuit can drive three column scanning lines, which greatly reduces the space occupied by driving circuit and furthermore reduces the width of the frame of the display panel.

As mentioned above, while the present disclosure has been disclosed via preferred embodiments as above, the preferred embodiments are not intended to limit the disclosure. Those skilled in the art can make various modifications and alternations without departing from the spirit and scope of the disclosure. The scope of protection of the disclosure is defined by the claims.

What is claimed is:

1. A driving circuit of a display device, comprising:

an output module comprising a signal main line and a signal output sub-module, and the output module is used for providing a plurality of scanning signals for displaying, the plurality of scanning signals are cascaded;

a signal amplification module used for amplifying the plurality of scanning signals;

a plurality of signal conversion modules, corresponding one-to-one to the plurality of amplified scanning signals, the plurality of signal conversion modules used for converting each of the plurality of amplified scanning signals into at least two column scanning signals; and a plurality of column scanning signals, corresponding one-to-one to the plurality of scanning signals, and the plurality of column scanning signals are used for transferring the plurality of column scanning signals to a display control circuit of the display device;

wherein each of the signal conversion modules at least comprises a first signal conversion unit and a second signal conversion unit;

the first signal conversion unit comprises a first conversion thin film transistor and a second conversion thin film transistor; wherein a source of the first conversion thin film transistor is connected to a first secondary clock signal, a gate of the first conversion thin film transistor is connected to an output terminal of the signal amplification module, a drain of the first conversion thin film transistor is connected to a source of the second conversion thin film transistor and outputs a first column scanning signal;

a gate of the second conversion thin film transistor is connected to a second secondary clock signal, a drain of the second conversion thin film transistor is connected to a third DC voltage;

the second signal conversion unit comprises a third conversion thin film transistor and a fourth conversion thin film transistor; wherein a source of the third conversion thin film transistor is connected to the second secondary clock signal, a gate of the third conversion thin film transistor is connected to an output terminal of the signal amplification module, a drain of the third of the conversion thin film transistor is connected to a source of the fourth conversion thin film transistor and outputs a second column scanning signal; and a gate of the fourth conversion thin film transistor is connected to a third secondary clock signal, a drain of the fourth conversion thin film transistor is connected to the third DC voltage, wherein the first secondary clock signal, the second secondary clock signal and the third secondary clock signal are different secondary clock signals.

2. The driving circuit of the display device as claimed in claim 1, wherein the signal conversion modules comprises at least two secondary clock signals, the plurality of secondary clock signals have a same period and duty ratio; wherein a sum of pulse widths of the plurality of secondary clock signals are same as a pulse width of the plurality of amplified scanning signals.

3. The driving circuit of the display device as claimed in claim 2, wherein a number of the plurality of secondary clock signals are same as a number of the column scanning signals.

4. The driving circuit of the display device as claimed in claim 1, wherein each of the signal conversion modules comprises a third signal conversion unit, the third signal conversion unit comprises a fifth conversion thin film transistor and a sixth conversion thin film transistor; wherein a source of the fifth conversion thin film transistor is connected to the third secondary clock signal, a gate of the fifth conversion thin film transistor is connected to an output terminal of the signal amplification module, a drain of the fifth of the conversion thin film transistor is connected to a source of the sixth conversion thin film transistor and outputs a third column scanning signal;

a gate of the sixth conversion thin film transistor is connected to the first secondary clock signal, a drain of the sixth conversion thin film transistor is connected to the third DC voltage.

5. The driving circuit of the display device as claimed in claim 1, wherein the signal amplifying module comprise:

a pull-up unit, the pull-up unit is used for converting a clock signal to a stage-by-stage transmission signal and converting a DC voltage signal to an output signal;

a pull-up control unit, the pull-up control unit is used for controlling an opening time of the pull-up unit;

a bootstrap capacitor, the bootstrap capacitor is used for uplifting the stage-by-stage transmission signal and outputting a signal voltage;

a pull-down unit, the pull-down unit is used for descending an output voltage of the bootstrap capacitor to a low voltage;

a pull-down maintenance unit, the pull-down maintenance unit is used for keeping the output voltage of the bootstrap capacitor in a low voltage;

an Inverter, the inverter is used for making the output voltage of the bootstrap capacitor be opposite to the output voltage of the pull-down maintenance unit; and a feedback unit, the feedback unit is used for uplifting the output voltage of the pull-down unit.

6. The driving circuit of the display device as claimed in claim 5, wherein the pull-up unit comprises a first pull-up unit and a second pull-up unit;

the first pull-up unit comprises a first pull-up thin film transistor and a second pull-up thin film transistor; wherein a source of the first pull-up thin film transistor is connected to a first DC voltage, a drain of the first pull-up thin film transistor is connected to one of electrode plate of the bootstrap capacitor, a gate of the first pull-up thin film transistor is connected to another electrode plate of the bootstrap capacitor;

a source of the second pull-up thin film transistor is connected to the first DC voltage, a drain of the second pull-up thin film transistor is connected to the another electrode plate of the bootstrap capacitor, a gate of the first pull-up thin film transistor is connected to a last stage-by-stage transmission signal;

the second pull-up unit comprises a third pull-up thin film transistor, a source of the third pull-up thin film transistor is connected to a second clock signal, a gate of the third pull-up thin film transistor is connected to the one of electrode plate of the bootstrap capacitor, a drain of the third pull-up thin film transistor is connected to another electrode plate of the bootstrap capacitor.

7. The driving circuit of the display device as claimed in claim 6, wherein the pull-up control unit comprises a first control thin film transistor and a second control thin film transistor; wherein a source of the first control thin film transistor is connected to the last stage-by-stage transmission signal, a gate of the first control thin film transistor is connected to a first clock signal, a drain of the first control thin film transistor is connected to a source of the second control thin film transistor;

a gate of the second control thin film transistor is connected to the first clock signal, a drain of the second control thin film transistor is connected to the pull-down maintenance unit.

8. The driving circuit of the display device as claimed in claim 7, wherein the pull-down unit comprises a first pull-down unit and a second pull-down unit; wherein the first pull-down unit comprises a first pull-down thin film transistor, a source of the first pull-down thin film transistor is connected to the first pull-up unit, a gate of the first pull-down thin film transistor is connected to a next stage-by-stage transmission signal, a drain of the first pull-down thin film transistor is connected to the third DC voltage;

the second pull-down unit comprises a second pull-down thin film transistor and a third pull-down thin film transistor, a source of the second pull-down thin film transistor is connected to the second pull-up unit, a gate of the second pull-down thin film transistor is connected to a next stage-by-stage transmission signal, a drain of the second pull-down thin film transistor is connected to a source of the third pull-down thin film transistor;

a gate of the third pull-down thin film transistor is connected to a next stage-by-stage transmission signal, a drain of the third pull-down thin film transistor is connected to the third DC voltage.

9. The driving circuit of the display device as claimed in claim 8, wherein the inverter comprises a first inverter and a second inverter; wherein the first inverter comprises a first inverse thin film transistor, a second inverse thin film transistor, a third inverse thin film transistor and a fourth inverse thin film transistor;

a source and a gate of the first inverse thin film transistor is connected to the second pull-down unit, a drain of the first inverse thin film transistor is connected to a source of the second inverse thin film transistor;

a gate of the second inverse thin film transistor is connected to the second pull-down unit, a drain of the second inverse thin film transistor is connected to the third DC voltage;

a source of the third inverse thin film transistor is connected to the second pull-down unit, a gate of the third inverse thin film transistor is connected to the drain of the first inverse thin film transistor, a drain of the third inverse thin film transistor is connected to a source of the fourth inverse thin film transistor;

a gate of the fourth inverse thin film transistor is connected to the gate of the second inverse thin film transistor, a drain of the fourth inverse thin film transistor is connected to the third DC voltage;

the second inverter comprises a fifth inverse thin film transistor, a sixth inverse thin film transistor, a seventh inverse thin film transistor and an eighth inverse thin film transistor;

a source and a gate of the fifth inverse thin film transistor is connected to the feedback unit, a drain of the fifth inverse thin film transistor is connected to a source of the sixth inverse thin film transistor;

a gate of the sixth inverse thin film transistor is connected to the second pull-up unit, a drain of the sixth inverse thin film transistor is connected to the third DC voltage;

a source a of the seventh inverse thin film transistor is connected to the feedback unit, a gate of the seventh inverse thin film transistor is connected to the drain of the fifth inverse thin film transistor, a drain of the seventh inverse thin film transistor is connected to a source of the eighth inverse thin film transistor;

a gate of the eighth inverse thin film transistor is connected to the gate of the sixth inverse thin film transistor, a drain of the eighth inverse thin film transistor is connected to the third DC voltage.

10. The driving circuit of the display device as claimed in claim 9, wherein the feedback unit comprises a feedback thin film transistor, a source of the feedback thin film transistor is connected to the first pull-up unit, a drain of the feedback thin film transistor is connected to the pull-up control unit, a gate of the feedback thin film transistor is connected to a present stage-by-stage transmission signal.

11. The driving circuit of the display device as claimed in claim 10, wherein the bootstrap capacitor comprises a first storage capacitor and a second storage capacitor; wherein one of electrode plate of the first storage capacitor is connected to the first pull-up unit, another electrode plate of the first storage capacitor is connected to the first pull-down maintenance unit;

one of electrode plate of the second storage capacitor is connected to the second pull-up unit, another electrode plate of the second storage capacitor is connected to the second pull-down maintenance unit.

12. The driving circuit of the display device as claimed in claim 11, wherein each of the signal conversion modules at least comprises a first signal conversion unit and a second signal conversion unit;

the first signal conversion unit comprises a first conversion thin film transistor and a second conversion thin film transistor; wherein a source of the first conversion thin film transistor is connected to a first secondary clock signal, a gate of the first conversion thin film transistor is connected to an output terminal of the signal amplification module, a drain of the first conversion thin film transistor is connected to a source of the second conversion thin film transistor and outputs a first column scanning signal;

a gate of the second conversion thin film transistor is connected to a second secondary clock signal, a drain of the second conversion thin film transistor is connected to a third DC voltage;

the second signal conversion unit comprises a third conversion thin film transistor and a fourth conversion thin film transistor; wherein a source of the third conversion thin film transistor is connected to the second secondary clock signal, a gate of the third conversion thin film transistor is connected to an output terminal of the signal amplification module, a drain of the third of the conversion thin film transistor is connected to a source of the fourth conversion thin film transistor and outputs a second column scanning signal;

a gate of the fourth conversion thin film transistor is connected to a third secondary clock signal, a drain of the fourth conversion thin film transistor is connected to the third DC voltage.

13. The driving circuit of the display device as claimed in claim 12, wherein each of the signal conversion modules comprises a third signal conversion unit, comprising a fifth conversion thin film transistor and a sixth conversion thin film transistor; wherein a source of the fifth conversion thin film transistor is connected to the third secondary clock signal, a gate of the fifth conversion thin film transistor is connected to an output terminal of the signal amplification module, a drain of the fifth of the conversion thin film transistor is connected to a source of the sixth conversion thin film transistor and outputs a third column scanning signal;

a gate of the sixth conversion thin film transistor is connected to the first secondary clock signal, a drain of the sixth conversion thin film transistor is connected to the third DC voltage.

* * * * *